US009235938B2

(12) United States Patent
Sixt, Jr. et al.

(10) Patent No.: US 9,235,938 B2
(45) Date of Patent: Jan. 12, 2016

(54) APPARATUS AND METHOD FOR MEASURING OPERATIONAL DATA FOR EQUIPMENT USING SENSOR BREACH DURATIONS

(75) Inventors: Fred Warner Sixt, Jr., Carlsbad, CA (US); Satish N. Ram, Poway, CA (US)

(73) Assignee: OMNITRACS, LLC, Dallas, TX (US)

( * ) Notice: Subject to any disclaimer, the term of this patent is extended or adjusted under 35 U.S.C. 154(b) by 387 days.

(21) Appl. No.: 11/777,235

(22) Filed: Jul. 12, 2007

(65) Prior Publication Data

US 2009/0015422 A1 Jan. 15, 2009

(51) Int. Cl.

| | |
|---|---|
| ***G08B 21/00*** | (2006.01) |
| ***G07C 5/08*** | (2006.01) |
| ***G07C 3/00*** | (2006.01) |
| ***G07C 5/00*** | (2006.01) |

(52) U.S. Cl.
CPC *G07C 5/085* (2013.01); *G07C 3/00* (2013.01); *G07C 5/008* (2013.01)

(58) Field of Classification Search
USPC ..... 340/679
See application file for complete search history.

(56) References Cited

U.S. PATENT DOCUMENTS

| | | | | |
|---|---|---|---|---|
| 5,844,800 | A * | 12/1998 | Brandt et al. | 700/97 |
| 6,295,492 | B1 | 9/2001 | Lang et al. | |
| 6,370,454 | B1 * | 4/2002 | Moore | 701/29 |
| 6,594,579 | B1 | 7/2003 | Lowrey et al. | |
| 6,604,033 | B1 | 8/2003 | Banet et al. | |
| 6,611,740 | B2 | 8/2003 | Lowrey et al. | |
| 6,636,790 | B1 | 10/2003 | Lightner et al. | |
| 6,732,031 | B1 | 5/2004 | Lightner et al. | |
| 6,732,032 | B1 | 5/2004 | Banet et al. | |
| 6,879,894 | B1 | 4/2005 | Lightner et al. | |
| 6,892,131 | B2 | 5/2005 | Coffee et al. | |
| 6,928,348 | B1 | 8/2005 | Lightner et al. | |
| 6,941,202 | B2 | 9/2005 | Wilson et al. | |
| 6,957,133 | B1 | 10/2005 | Hunt et al. | |
| 6,988,033 | B1 | 1/2006 | Lowrey et al. | |
| 7,002,462 | B2 | 2/2006 | Welch | |
| 7,113,127 | B1 | 9/2006 | Banet et al. | |
| 7,174,243 | B1 | 2/2007 | Lightner et al. | |
| 7,225,065 | B1 | 5/2007 | Hunt et al. | |
| 7,228,211 | B1 | 6/2007 | Lowrey et al. | |
| 7,312,703 | B2 * | 12/2007 | Hoogenboom | 340/540 |
| 7,477,968 | B1 | 1/2009 | Lowrey et al. | |
| 7,523,159 | B1 | 4/2009 | Williams et al. | |
| 7,532,962 | B1 | 5/2009 | Lowrey et al. | |
| 7,532,963 | B1 | 5/2009 | Lowrey et al. | |
| 2003/0055666 | A1 | 3/2003 | Roddy et al. | |
| 2003/0060949 | A1 | 3/2003 | Letang et al. | |

(Continued)

OTHER PUBLICATIONS

International Search Report, PCT/US2008/069739, International Search Authority, United States Patent & Trademark Office, Jan. 14, 2009.

(Continued)

*Primary Examiner* — Ojiako Nwugo
(74) *Attorney, Agent, or Firm* — Arent Fox LLP

(57) ABSTRACT

A wireless equipment management system that is configured to track sensors for work measurement for predetermined events. The sensors are configured to measure event durations of a specific piece of equipment as defined by a user and sent to a Network Management Center. This enables the user to measure work times by configuring work events as sensor input events. The event durations can be displayed and reports can be produced at the Network Management Center.

30 Claims, 4 Drawing Sheets

(56) References Cited

U.S. PATENT DOCUMENTS

| | | | | |
|---|---|---|---|---|
| 2004/0073468 | A1* | 4/2004 | Vyas et al. | 705/8 |
| 2004/0113761 | A1 | 6/2004 | Borugian | |
| 2005/0143956 | A1 | 6/2005 | Long et al. | |
| 2005/0210340 | A1* | 9/2005 | Townsend et al. | 714/701 |
| 2005/0249333 | A1* | 11/2005 | Baker et al. | 379/32.01 |
| 2005/0256681 | A1 | 11/2005 | Brinton et al. | |
| 2006/0213731 | A1* | 9/2006 | Lesesky et al. | 188/158 |
| 2006/0273896 | A1 | 12/2006 | Kates | |
| 2006/0276185 | A1 | 12/2006 | Ram et al. | |
| 2007/0200664 | A1* | 8/2007 | Proska et al. | 340/5.42 |
| 2007/0208476 | A1* | 9/2007 | Baginski et al. | 701/50 |
| 2007/0288154 | A1* | 12/2007 | Letang | 701/112 |
| 2008/0059080 | A1* | 3/2008 | Greiner et al. | 702/33 |
| 2008/0059411 | A1* | 3/2008 | Greiner et al. | 707/2 |
| 2008/0180523 | A1* | 7/2008 | Stratton et al. | 348/114 |
| 2008/0234837 | A1* | 9/2008 | Samudrala et al. | 700/19 |
| 2009/0006540 | A1* | 1/2009 | Liu et al. | 709/203 |

OTHER PUBLICATIONS

Written Opinion, PCT/US2008/069739, International Search Authority, United States Patent & Trademark Office, Jan. 14, 2009.

SAE J1708, "Serial Data Communications between Microcomputer Systems in Heavy-Duty Vehicle Applications," Aug. 2004.

SAE J1939, "Recommended Practice for a Serial Control and Communications Vehicle Network," Issued Apr. 2000, Revised Oct. 2007.

* cited by examiner

APPARATUS AND METHOD FOR MEASURING OPERATIONAL DATA FOR EQUIPMENT USING SENSOR BREACH DURATIONS

CLAIM OF PRIORITY UNDER 35 U.S.C §120

The present Application for Patent is related to the following co-pending U.S. Patent Applications:

"WIRELESS SYSTEM FOR PROVIDING CRITICAL SENSOR ALERTS FOR EQUIPMENT" by Satish Ram and Charles Pederseii, having U.S. patent application Ser. No. 11/230352, filed on Sep. 19, 2005, assigned to the assignee hereof, and expressly incorporated by reference herein; and "SYSTEM FOR PROVIDING MULTIPLE MAINTENANCE PROFILES USING WIRELESS COMMUNICATIONS" by Satish Ram, Loyie Sims III, and Robert McCloskoy, having U.S. patent application Ser. No. 11/231,000, filed on Sep. 19, 2005, assigned to the assignee hereof, both patent applications claiming priority to U.S. Provisional Patent Application No. 60/688,626, filed on Jun. 7, 2005, all of these patent applications being expressly incorporated by reference herein.

BACKGROUND

1. Field

The present invention relates to monitors and more particularly to a method and apparatus for remote construction equipment monitoring.

2. Background

Monitoring and managing equipment in remote locations presents a challenging task, particularly for equipment leasing companies. This task becomes even more challenging for mobile equipment such as heavy construction vehicles. Notification in real time of problems, run thresholds, and work durations which occur in the field can prove to be very useful in scheduling maintenance. Operation of equipment in such a manner may create additional equipment problems or which may exacerbate existing problems.

The current Qualcomm® GlobalTRACS® system provides users the ability to configure up to 4 digital sensors to monitor equipment alerts such as high temp or pressure for equipment health and preventive maintenance purposes. The system allows users to configure the alert thresholds for each sensor as well as the notification mechanism when the alert occurs. Users can view and acknowledge alerts on the web as well as run a report listing all equipment alerts for a specified time period. However, there is a need to remotely measure work durations of various kinds to help users with accurate job costing, productivity improvements, and utilization measurements. Examples include measuring the amount of dig time, drill, time, PTO (power take off) time, idle time, etc. Utilizing the GlobalTRACS® wireless equipment management system and providing specific enhanced features (duration measurement configuration and reporting) to help users track operational data in customizable ways, will provide an automated method for collecting and reporting such data.

Currently, there are many manual methods being used to track operational data from construction equipment; however these are physically on the equipment and are not automated.

The present invention allows a machine owner or manager to remotely observe and measure equipment performance and work parameters via the internet, and alerts via text or cell in a reliable manner and results in a usable business product.

SUMMARY

The present invention comprises a method and apparatus for monitoring and measuring machine parameters, for machines such as construction equipment or the like, including operating conditions outside of preset parameters, and to remotely obtain these parameters.

The disclosed embodiments provide users the ability to set duration measurements for specific sensors using the GlobalTRACS web (GT/web) and simplify the configuration for such sensors (ignore critical alert, auto acknowledge breach alerts, etc.) as well as to provide the necessary reporting/viewing screens that summarize duration measurements. The GT/web system is modified to add a duration flag for each sensor set up. If the duration flag is checked by the user, the sensor is configured to send breach and reset alert with next message, and critical alerts are set to be ignored. The GT/web system can auto-acknowledge all duration sensor alert messages and not escalate these messages. In addition, GT/web system can store all durations for such sensors and present it to the user in the form of a summarized report showing cumulative duration and percentage for the specified time periods (day, week, etc.).

An object of the present invention is to provide a method sad apparatus to accurately determine machine usage parameters remotely.

An advantage of the present invention is that the behavior of the machine and much of the operator's behavior can be measured without being near the machine.

Another advantage of the present invention is that events that occur multiple times during the day can be counted automatically and accurately, which in the past would have been done by another person observing the machine.

Another advantage of the invention is the augmentation of the GlobalTRACS® system.

Yet another advantage of the invention is its versatility, in that it can be used with any machine or make.

Yet another advantage of this invention is ability to better manage maintenance of equipment components based on actual usage as measured by sensor durations.

DETAILED DESCRIPTION

Figure 1:
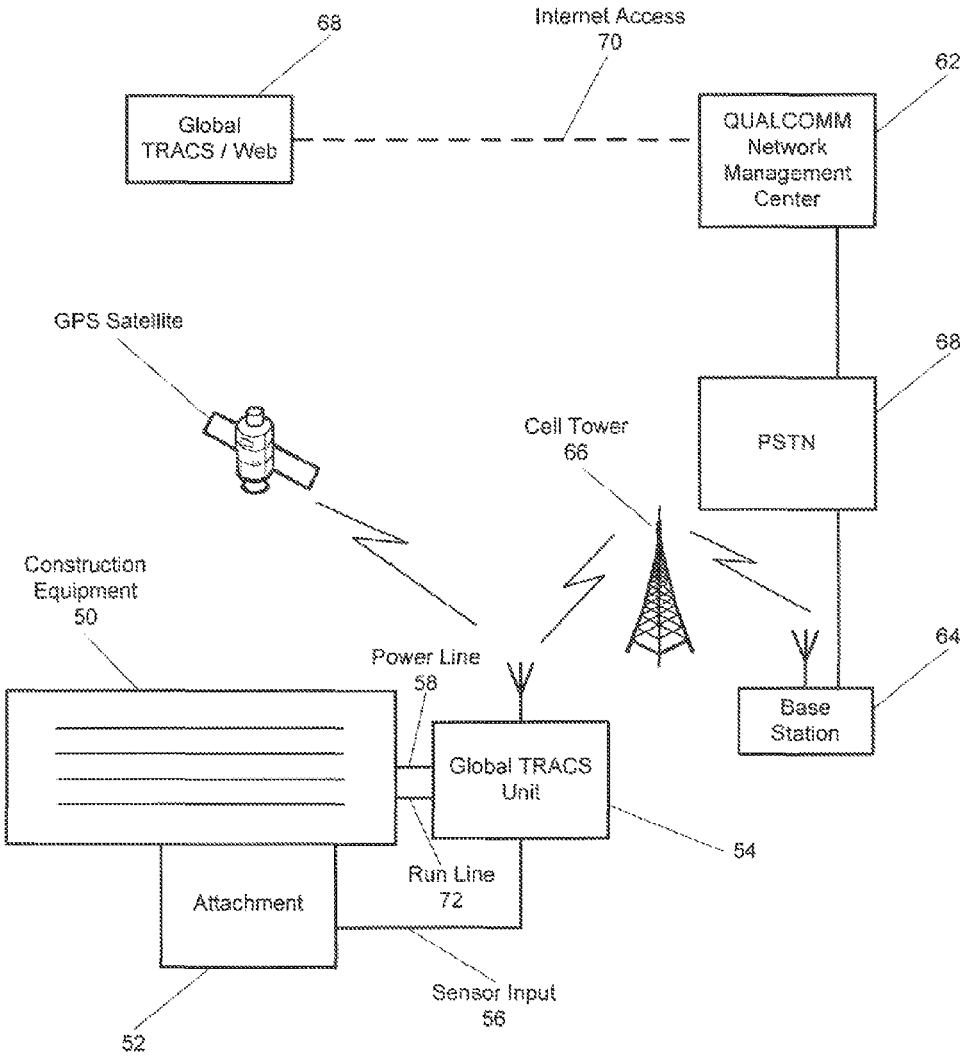
FIG. 1 depicts a typical monitoring system.

The system, described in this document enables users to measure attachment usage times and other operational data by configuring work events as sensor input events. FIG. 1 shows an exemplary Qualcomm® GlobalTRACS® system and associated components for monitoring equipment. A typical system will comprise a piece of construction equipment 50 having an attachment 52 which is connected to the GlobalTRACS® unit (terminal) 54 via one of its sensor input ports. Terminal 54 is mounted on the piece of equipment 50 and is powered from the equipment battery via power line 58. The terminal uses GPS, from a satellite 60, or the like, to get location information and has a wireless modem to communicate data back to the Network Management Center (NMC) 62 via a base station 64, a cell tower 66, and Public Switched Telephone Network (PSTN) 68. Users manage equipment related data using GlobalTRACS®/web (GT/web) 68 which is connected to NMC 62 via the internet 70. The system (GlobalTRACS®) tracks equipment run time via the run terminal line 72, as shown. In addition, the system tracks sensor breach duration using the sensor input line 56, as shown. GlobalTRACS® system currently supports up to 4 sensor input lines. The sensor lines can be configured by the user to not only notify on sensor breach, but also to keep track of duration of breach or a count of the number of breach events. This lime duration or breach count can be used for operational and productivity measurements.

Figure 2:
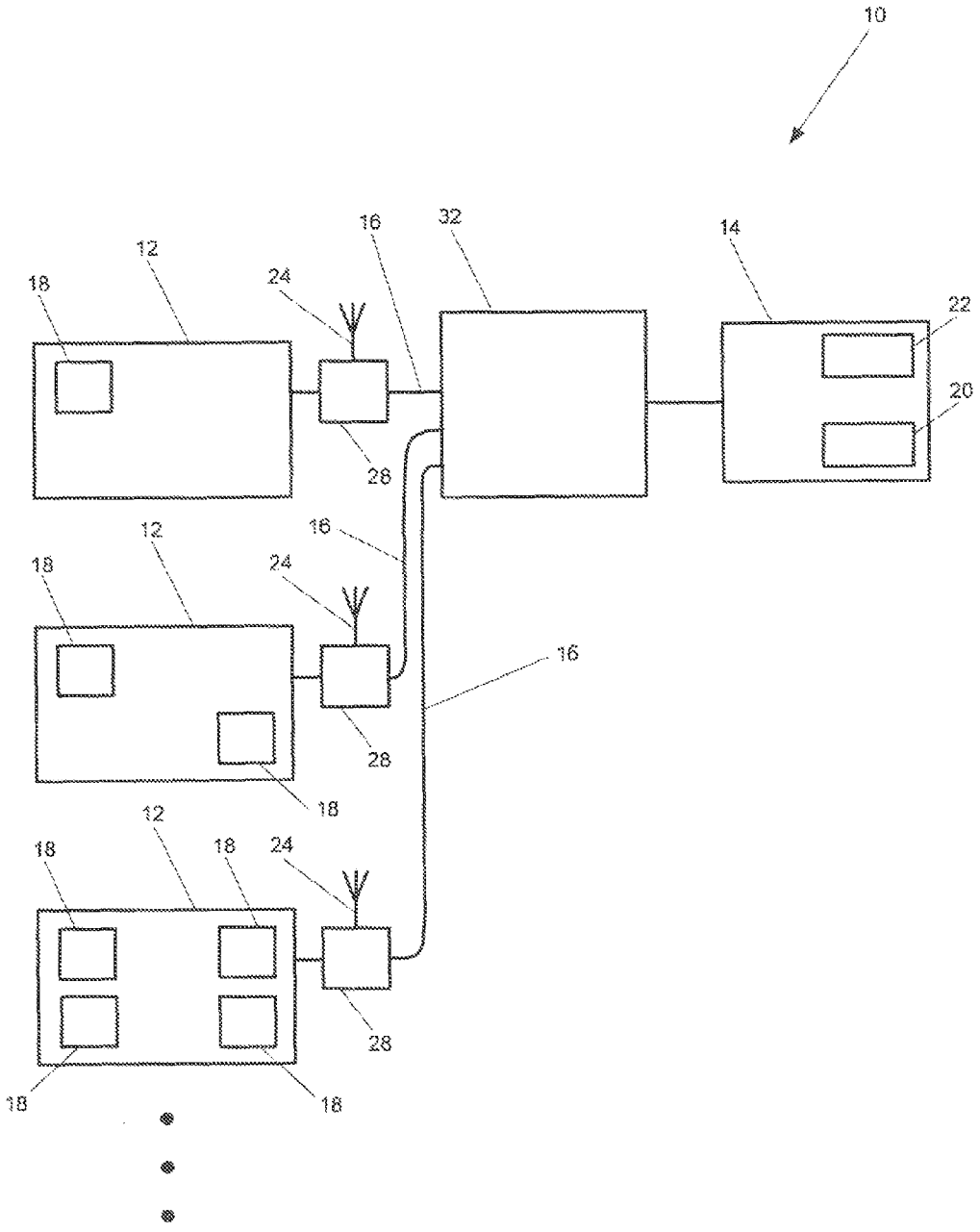
FIG. 2 is a block diagram of an equipment management system.

The system described in this document enables users to measure attachment usage times and other operational data by configuring work events as sensor input events. FIG. 1 shows an exemplary Qualcomm® GlobalTRACS® system and associated components for monitoring equipment. The present invention utilizes this system to achieve its novel features. FIG. 2 illustrates a block diagram of equipment, management system 10 for managing equipment 12 such as mobile or non-mobile machines. FIG. 2 shows a plurality of monitored equipment 12 (coupled to data processing center 14 through wireless communications link 16). Equipment 12 can represent heavy equipment, office equipment, surface, land and air vehicles, etc. This includes, but is not limited to engines, automobiles, trucks, construction, agricultural or earthmoving equipment, computers, consumer electronics, copiers, printers, facsimile machines, etc., (communications link 16 can include a satellite data link, an antenna 24 used for transmitting and receiving signals, an analog cellular telephone communications link (using, for instance, frequency division multiple access (FDMA), a digital cellular communications link (using e.g., code division multiple access (CDMA), time division multiple access (TDMA), etc.) a radio link, Bluetooth, Wi-fi (802.11a, 802.11b, 802,11g etc), or a combination thereof. Data processing center 14 receives status information related to monitored equipment 12 through system controller 32. In one aspect, each monitored piece of equipment 12 can include one or more sensors 18 for measuring equipment usage or operating characteristics. In one embodiment, data processing center 14 receives signals, via communications link 16 from the one or more sensors 18, containing data relating to equipment usage and/or operating characteristics. The received data is stored at data processing center 14 which can adaptively track the operation of each piece of monitored equipment 12 based on data from sensors 18. For example, equipment 12 shown could represent an engine wherein a sensor 18 measures odometer mileage. Another sensor 18 can measure, for instance, ambient operating temperatures. An oil change maintenance schedule and an oil type can be calculated at data processing center 14 based upon the data supplied by sensors 18. For instance, under predominantly and relatively high ambient temperatures, a higher weight oil and more frequent oil change scheduling at shorter odometer mileage intervals between scheduled oil changes may be prescribed to reduce engine wear. Predominantly cooler ambient, temperatures over longer odometer readings may dictate lower weight oil with more miles between oil changes. Consequently, an engine or piece of heavy equipment operating in area near the Sahara Desert in Africa could have an entirely different maintenance schedule from the same engine operating in Iceland, as determined by processing center 14. Alternatively, in the case of a copier or facsimile machine, sensor 18 can measure toner levels and copier usage hours to adaptively determine toner cartridge replacement scheduling and/or ordering. In addition, should a fault condition occur at the monitored equipment, such as no oil sensed in the engine, an alarm or alert can be processed to the equipment operator. The preferred sensor(s) are designed to communicate with a telematic device on the construction equipment which transmits immediately (if requested) a performance characteristic which was set to be monitored.

Data processing center 14 can contain one or more servers which operate to ran computer programs that manage alerts and/or prepare equipment maintenance schedules for a plurality of equipment 12. Equipment operating data, historical usage data, maintenance schedules, and equipment location information can also he tracked and maintained by one or more servers at data processing center 14.

Equipment manager 20 within data processing center 14 can be implemented as a server programmed to calculate operation recommendations in the case of alerts and servicing schedules for each monitored piece of equipment 12. Data on each monitored piece of equipment can be maintained in memory storage represented by functional block 22 as accomplished, for instance, in the same server as that for equipment manager 20 or in a separate server therefrom for storage of collected data. This data includes equipment specifications, and operating data including historical usage data. For instance, information relating to repair histories, in-service hours, fuel consumption, location information and operating costs can be stored in memory storage 22.

The current GlobalTRACS® system provides users the ability to configure up to 4 digital sensors to monitor equipment alerts such as high temp or pressure for preventive maintenance purposes. The system allows users to configure the alert thresholds for each sensor as well as the notification mechanism when the alert occurs. Users can view and acknowledge alerts on GlobalTRACS®/web, run a report listing all equipment alerts for a specified time period and monitor sensor inputs to determine work durations and counts to determine productivity measurements. These duration measurements can be used to trigger maintenance alerts basal on separate maintenance profiles.

Wireless equipment system 10 is preferably a computer-based system that uses the Transmission Control Protocol/Internet Protocol (TCP/IP) networking protocol. Further this system 10 is suitable for the Internet, particularly with broadband Internet. Wireless system 10 is accessible from multiple sources concerning operational data measurements. Different levels of security can be meted out to each system user depending on information needs, etc.

Wireless equipment system 10 can be implemented using a combination of wireless technology, data handling functionality in the construction industry as provided, for example, by an equipment management solution such as GlobalTRACS® by Qualcomm®. An equipment management solution automatically collects, organizes, and transmits vital information concerning how the equipment is being used, how much equipment is being used, as well as the location of that equipment. This information is especially useful to entities renting, distributing, contracting or owning equipment, particularly construction equipment. The equipment management solution can track equipment use such as engine hour use as reported by a sensor tracking usage hours of a system on a piece of equipment, such as an engine. Further, the equipment management solution can provide global positioning system (GPS)-based equipment location information including data indicating when a piece of equipment has moved outside of a pre-set boundary.

Figure 3:
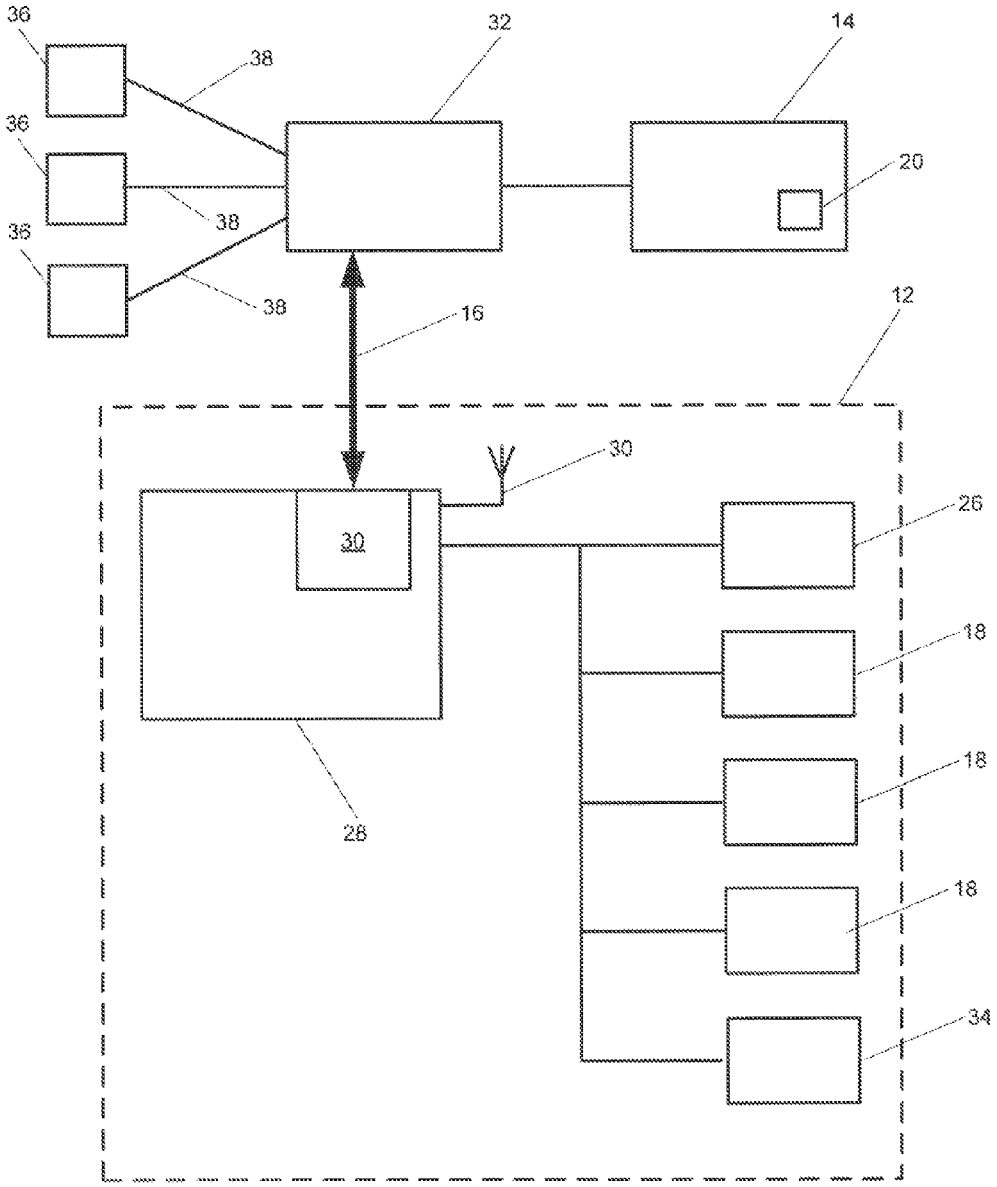
FIG. 3 is a block diagram of illustrating how each sensor and/or controller on a piece of equipment is used to monitor or control equipment or system or function on equipment.

FIG. 3 is a block diagram of illustrating how each sensor 18 and/or controller 26 on a piece of equipment 12 is used to monitor or control equipment 12 or system or function on equipment 12. In one embodiment, each sensor 18 and controller 26 on equipment 12 is connected through a controller area network (CAN).

In one embodiment each sensor 18 and controller 26 on the same piece of equipment 12 can act as a CAN slave device connected to a CAN master controller 28. Master controller 28 includes communications module 30 which is used in connection with transmitting and receiving Code Division Multiple Access (CDMA) signals. However, other communications systems for use in connection with communications module 30 are contemplated, e.g., Time Division Multiple Access, etc., each which is well known in the art.

Data received by each sensor 18 on a piece of equipment 12 is sent to CAN master controller 28 where it is stored until downloaded by system controller 32 through wireless communications link 16.

Operator controller 34 receives the work duration information in the form of a message, instructions, alarms, etc. to warn an equipment operator (not shown) of critical alert conditions (surpassed time period, high RPM, etc.) sensed on equipment 12 by a sensor 18, thereby allowing the operator to take or institute corrective or preventative action. This can include "ignore" or "send with next message" instructions.

Equipment manager 20 in conjunction with data processing center 14 analyzes data received from each CAN master controller 28. As a result, equipment manager 20 issues maintenance recommendations, alerts, alarms to system controller 32 which in turn forwards the same to a user control/monitoring site 36. A control/monitoring site 36 can represent, for instance, the owner of rental equipment. Through link 38, communications can he had between, each control/monitoring site 36 and equipment manager 20 through system controller 32 pertaining to a specified piece of equipment 12. Communications over link 38 can occur by numerous ways. For instance, these communications can occur over the Internet, via e-mail, text messages, etc. Equipment manager's 20 function can adapt to inputs, requests, etc. from control/monitoring sites 36. For instance, a maintenance step can be moved up ahead of schedule at the request of a control/monitoring site 36.

Figure 4:
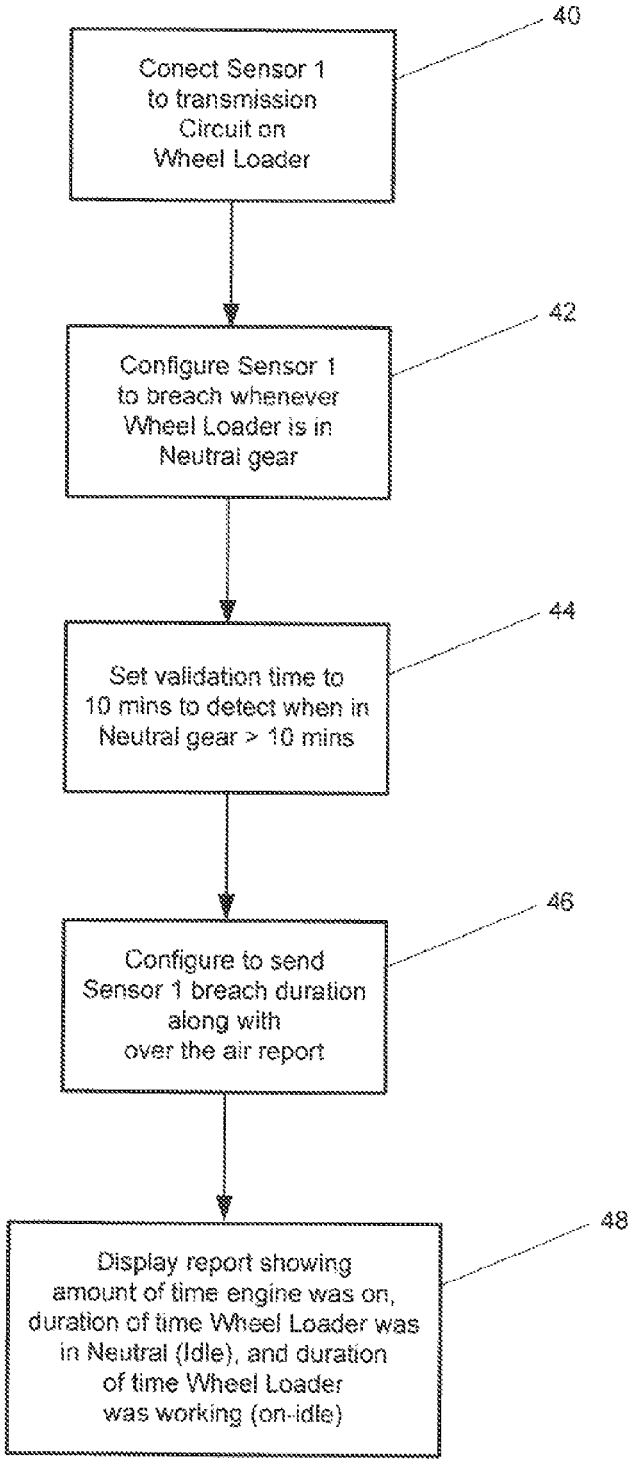
FIG. 4 is a flow chart depicting a typical implementation of the described embodiments.

FIG. 4 is a flow chart showing an example of a typical use of the invention. In the example shown in FIG. 4, a sensor is connected to a transmission circuit on a wheel loader 40. The sensor is configured to breach whenever a wheel loader is in neutral gear 42. A validation time is set 44, in this example to detect when in neutral for longer than 10 minutes. Thus, the terminal tracks the amount of time the attachment was in use by tracking amount of time the sensor was in breach state 44, configures the data to send the sensor breach duration along with all over the air report 46 and sends the duration data using wireless communications to the NMC. GT/web presents this duration data as part of the equipment's utilization measurement. A display report showing the duration information is then created 48. This information can then be presented on a customer web page indicating time of the event and duration.

The GlobalTRACS® system also provides the ability to track multiple maintenance profiles for a piece of equipment. With the ability to track sensor durations and counts, the system can be designed to support user configuration of these sensor durations for maintenance purposes using separate maintenance profiles. This will enable users to schedule preventive maintenance based not only on main engine hours, but also on other items such as fuel consumed, attachment hours or counts using sensor inputs.

INDUSTRIAL APPLICABILITY

The invention is further illustrated by the following non-limiting examples:

Example I

A customer wants to measure work duration by defining work as whenever engine is in forward or reverse gear. Otherwise, if engine is ON, it is idling and not working. Customer configures a sensor as 'Work Duration' and connects to sensor which triggers whenever engine is in forward or reverse gear.

Example II

A customer wants to measure work duration by defining work as whenever engine is running at greater than 1500 RPM. At lower RPMs, equipment is idling. Customer configures a sensor as 'Work Duration' and connects to sensor which triggers whenever engine RPM exceeds 1500 RPM.

Example III

A customer wants to measure work duration by defining work as whenever the seat is in 180 degree position and the engine is ON if engine is ON and seat is in Normal (0) position, the equipment is idling. Customer configures a sensor as 'Work Duration' and connects to sensor which triggers whenever engine is ON and the seat is rotated 180 degrees.

Example IV

A customer wants to measure actual usage of an attachment such as a bucket or drill. A sensor is configured as 'Attachment Hours' and is connected so that it is triggered whenever the attachment is in use.

The preceding examples can be repeated with similar success by substituting the generically or specifically described reactants and/or operating conditions of this invention for those used in the preceding examples.

Among other benefits of this invention, the disclosed embodiments can be used to estimate production of the equipment and the operator. The triggering of the sensor indicates start time and the sensor going off indicates stop time. The total sum of these times can be used by equipment owners in a number of unique ways. For instance and estimate yards, tons of material moved, or how much time the operator actually was working versus idle.

An owner of a piece of equipment can measure "time in neutral with engine" on which would be "non-production time". The converse of this is production time. An owner can see the engine is running hot, and later returns to normal, this could be an operator error, or machine condition problem. Both are correctable problems if the owner knows remotely. Other uses are triggering a switch to start a cycle (from a load areas, traveling to an unload area, dumping and traveling back), so each event can be measured and totaled to compare times with other operators and improve process though this information.

Those of skill in the art would understand that information and signals may be represented using any of a variety of different technologies and techniques. For example, data, instructions, commands, information, signals, bits, symbols, and chips that may he referenced throughout: the above description may he represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection, with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such the processor can read information from, and write information to the storage medium. In the alternative, the storage medium may be integral to the processor. The processor and the storage medium may reside in an ASIC. The ASIC may reside in a user terminal. In the alternative, the processor and the storage medium may reside as discrete components, in a user terminal.

For a firmware and/or software implementation, the methodologies may be implemented, with modules (e.g., procedures, functions, and so on) that perform the functions described herein. Any machine readable medium tangibly embodying instructions may be used in implementing the methodologies described herein. For example, software codes may be stored in a memory, such as a memory of a mobile device, and executed by a processor or microprocessor. Memory may be implemented within the processor or external to the processor. As used herein the term "memory" refers to any type of long term, short term, volatile, nonvolatile, or other memory and is not to be limited to any particular type of memory or number of memories, or type of media upon which memory is stored.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the widest scope consistent with the principles and novel features disclosed herein.

What is claimed is:

1. A management system for equipment, comprising:

a processor located in a data processing center remote from the equipment, the processor being operable to:

receive operating data from at least one sensor located at the equipment, the at least one sensor being configured for sensing operating data pertaining to the equipment, and the operating data comprising one or more sensor breaches of the at least one sensor;

determine, from the one or more sensor breaches of the received operating data, one or more work durations for predetermined operations of the equipment; and generate, from data associated with the equipment, work duration reports comprising information on an amount of working time during which the equipment is turned on and is placed in any of a forward and a reverse gear, wherein the operating data comprise engine revolutions per minute (RPM); and wherein the work duration reports further comprise information on an amount of time that the engine is turned on and the engine RPM is equal to or greater than a predetermined limit.

2. The management system for equipment of claim 1, further comprising a display for displaying the determined one or more work durations.

3. The management system for equipment of claim 1, further comprising a report compiler for compiling reports of the determined one or more work durations.

4. The management system for equipment of claim 3, wherein the compiled reports further comprise identification information and chronological information associated with the equipment.

5. The management system for equipment of claim 1, wherein the equipment is selected from the group consisting of heavy equipment, office equipment and surface, land and air vehicles.

6. The management system of claim 1, wherein the operating data comprises at least one member from the group consisting of an engine gear position, engine revolutions per minute (RPMs), and a driver seat position.

7. The management system of claim 6, wherein the operating data comprises an engine gear position.

8. The management system of claim 7, wherein a sensor is configured to breach whenever the engine gear position is put in neutral.

9. The management system of claim 1, wherein the at least one sensor comprises a remotely configured sensor.

10. The management system of claim 9, wherein the remotely configured sensor comprises a sensor configured for alerts or duration.

11. The management system of claim 1, wherein the processor is further configured to:

generate, from data associated with the equipment and stored at the data processing center, an alert signal when the one or more work durations are inconsistent with an associated predetermined work duration;

generate, based on the data associated with the equipment, a maintenance schedule related to a servicing of the equipment;

forward the alert signal and the maintenance schedule to a monitoring site; and receive a request from the monitoring site to alter the maintenance schedule in response to forwarding the alert signal and the maintenance schedule.

12. The management system of claim 11, wherein the processor is further configured to:

track a location of the equipment; and generate the maintenance schedule further based on the location of the equipment.

13. The management system of claim 1, wherein the operating data comprises an engine gear position, wherein the at least one sensor is configured to breach whenever the engine gear position is put in neutral; and wherein the processor is further operable to detect when the engine gear position has been in neutral for a period of time longer than a predetermine period of time.

14. The management system of claim 13, wherein the processor is further operable to track an amount of time that the at least one sensor was in a breach state.

15. The management system of claim 1, wherein the predetermined limit is approximately 1500 RPM.

16. A non-transitory computer readable medium storing computer executable code, comprising:

code for causing at least one computer to obtain operating data of a piece of equipment via a wireless communication system from at least one sensor disposed on the piece of equipment, the operating data comprising one or more sensor breaches of the at least one sensor;

code for causing at least one computer to compute at least one work duration for predetermined operations of the piece of equipment based on the one or more sensor breaches of the operating data; and code for causing at least one computer to generate a report of the at least one work duration comprising information on an amount of working time during which the equipment is turned on and is placed in any of a forward and a reverse gear, wherein the operating data further comprise engine revolutions per minute (RPMs), and wherein the work duration reports further comprise information on an amount of time that the engine is turned on and the engine RPM is equal to or greater than a predetermined limit.

17. A management system for equipment, comprising:

a processor located in a data processing center remote from the equipment, the processor being operable to:

receive operating data from at least one sensor located at the equipment for sensing the operating data pertaining to the equipment, the operating data comprising one or more sensor breaches of the at least one sensor;

determine, from the one or more sensor breaches of the received operating data, one or more work durations for predetermined operations of the equipment; and generate, from data associated with the equipment, work duration reports comprising information on an amount of working time during which the equipment is turned on and is placed in any of a forward and a reverse gear, wherein the operating data comprise a driver seat position.

18. The management system of claim 17, wherein the work duration reports comprise information on an amount of time that the an engine is turned on and a seat for an operator is in a position for operator use and information on an amount of time that the engine is turned on and the seat is in an unused position.

19. The management system of claim 17, wherein the work duration reports comprise information on an amount of time that an engine is turned on and a seat for an operator is in a 180 degree position and information on an amount of time that the engine is turned on and the seat is in a normal position.

20. A system for managing equipment, comprising:

at least one sensor for sensing operating data pertaining to the equipment, the operating data comprising one or more sensor breaches of the at least one sensor; and a wireless communication system for providing communications among the at least one sensor, the equipment, and a remote processor located in a remote data processing center, wherein the wireless communication system provides the operating data to the remote processor, wherein the operating data is configured such that the remote processor can determine, from the one or more sensor breaches of the received operating data, one or more work durations for predetermined operations of the equipment, and generate, from data associated with the equipment, work duration reports comprising information on an amount of working time during which the equipment is turned on and is placed in any of a forward and a reverse gear, wherein the operating data comprises engine revolution per minute (RPM), and wherein the work duration reports further comprise information on an amount of time that the engine is turned on and the engine RPM is equal to or greater than a predetermined limit.

21. The system of claim 20, wherein the equipment is selected from the group consisting of heavy equipment, office equipment and surface, land and air vehicles.

22. The system of claim 20, wherein the operating data further comprise at least one member from the group consisting of an engine gear position and a driver seat position.

23. The system of claim 22, wherein the operating data further comprise an engine gear position.

24. The system of claim 23, wherein a sensor is configured to breach whenever the engine gear position is put in neutral.

25. The system of claim 20, wherein the at least one sensor comprises a remotely configured sensor.

26. The system of claim 25, wherein the remotely configured sensor comprises a sensor configured for alerts or duration.

27. A non-transitory computer readable medium storing computer executable code therein, comprising:

code for causing a processor of a computer to obtain operating data of a piece of equipment from at least one sensor disposed on a piece of equipment, the operating data comprising one or more sensor breaches of the at least one sensor;

code for causing the processor to wirelessly provide communications among the at least one sensor, the equipment, and a remote processor located in a remote data processing center, wherein the code for causing the processor to wirelessly provide communications is configured to provide the operating data to the remote processor, and wherein the operating data is configured such that the remote processor can determine, from the one or more sensor breaches of the received operating data, one or more work durations for predetermined operations of the equipment, and generate, from data associated with the equipment, work duration reports comprising information on an amount of working time during which the equipment is turned on and is placed in any of a forward and a reverse gear, wherein the operating data further comprise engine revolutions per minute (RPM), and wherein the work duration reports further comprise information on an amount of time that an engine of the equipment is turned on and the engine RPM is equal to or greater than a predetermined limit.

28. The non-transitory computer readable medium of claim 27, wherein the operating data further comprise a driver seat position.

29. The non-transitory computer readable medium of claim 27, wherein the operating data further comprise an engine gear position.

30. The non-transitory computer readable medium of claim 29, wherein the at least one sensor is configured to breach whenever the engine gear position is put in a neutral position.

* * * * *